United States Patent [19]

Fresard et al.

[11] 4,170,184

[45] Oct. 9, 1979

[54] MECHANISM FOR THE ADJUSTMENT OF THE DIRECTION AND OF THE AMPLITUDE OF THE MOVEMENT OF THE TRANSPORTING CLAW FOR MATERIAL TO BE SEWN ON A SEWING MACHINE

[75] Inventors: Marcel Fresard, Petit-Lancy; Norbert Raboud, Aire-Geneva, both of Switzerland

[73] Assignee: Mefina S.A., Fribourg, Switzerland

[21] Appl. No.: 862,982

[22] Filed: Dec. 21, 1977

[30] Foreign Application Priority Data

Dec. 28, 1976 [CH] Switzerland ..... 16371/76

[51] Int. Cl.[2] ..... D05B 27/00

[52] U.S. Cl. ..... 112/317; 112/319

[58] Field of Search ..... 112/210, 211, 209

[56] References Cited

U.S. PATENT DOCUMENTS

| | | | |
|---|---|---|---|
| 3,149,592 | 9/1964 | Casas-Robert | 112/210 |
| 3,426,712 | 2/1969 | Hanyu et al. | 112/210 |
| 3,455,258 | 7/1969 | Kasuga | 112/210 |
| 3,753,411 | 8/1973 | Graham et al. | 112/210 |
| 3,766,871 | 10/1973 | Mastuda et al. | 112/210 |

*Primary Examiner*—Ronald Feldbaum

*Attorney, Agent, or Firm*—Emory L. Groff, Jr.

[57] ABSTRACT

A mechanism for a sewing machine for enabling the manual or automatic control of the direction and of the amplitude of movement of a transporting claw guide for material to be sewn. The mechanism is driven from the main driving shaft of the sewing machine via a cam and a series of intermediate lever members connected to a rotatable shaft connected to the transporting claw guide. The control is automatically accomplished by means of a cam driven from the main driving shaft of the machine via the arrangement of levers to obtain back-and-forth movement of the claw guide or, when a cam follower is disengaged from the cam, the control can be accomplished manually without the automatic back-and-forth movement.

11 Claims, 6 Drawing Figures

MECHANISM FOR THE ADJUSTMENT OF THE DIRECTION AND OF THE AMPLITUDE OF THE MOVEMENT OF THE TRANSPORTING CLAW FOR MATERIAL TO BE SEWN ON A SEWING MACHINE

The present invention relates to a mechanism for the adjustment of the direction and of the amplitude of the movement of the transporting claw for material to be sewn on a sewing machine.

According to the present invention there is provided a mechanism for the adjustment of the direction and of the amplitude of the movement of a transporting claw guide for material to be sewn on a sewing machine, comprising a cam driven by a main driving shaft of the machine and acting via a series of intermediate members connected to the upper ends of a shaft, the lower end of which is connected to the mechanism of the transporting claw guide, wherein the series of intermediate members comprises a first lever, one of the ends of which is provided with a follower in contact with the surface of the cam, a reversing lever in contact with the other end of the first lever, a second lever for oscillating the shaft and mounted on the reversing lever in a longitudinally displaceable manner, a bearing member disposed on the upper end of the shaft opposite to the end connected to the mechanism of the transporting claw guide, and in contact with one end of the second lever and a third lever connecting the second lever to a control member for the longitudinal displacement of the second lever, to adjust the position of its end in contact with the bearing member.

The present invention will be described further by way of example, with reference to the accompanying drawings, in which.

Figure 1:
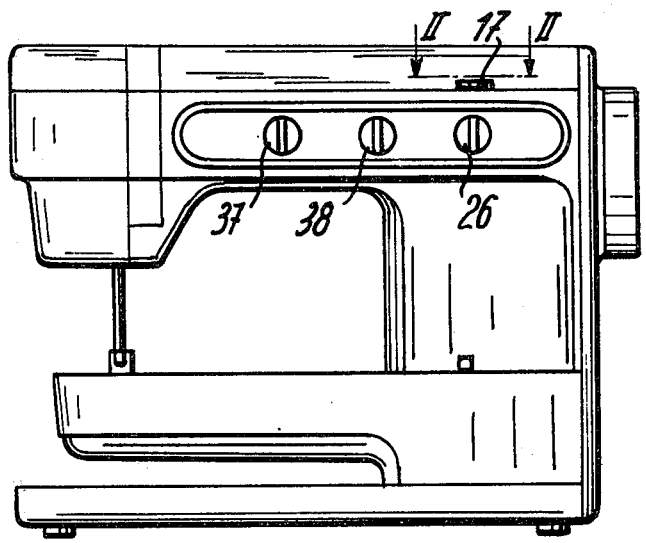
FIG. 1 is an elevational view of a sewing machine.

Sewing machines are known in which the transporting claw for the pieces of material to be sewn is driven from a motor driving the machine, the direction and amplitude of the movement of the claw being controlled from a cam mounted in the upper arm of the machine via a vertical shaft, as described, for example, in Swiss Pat. No. 342457.

Only the mechanism adapted to give diverse positions to the vertical shaft 1, with respect to a lever 2 for controlling the mechanism for regulating the amplitude and the direction of movement of the transporting claw, has been shown in the drawing, the rest of the mechanism being known.

Figure 2:
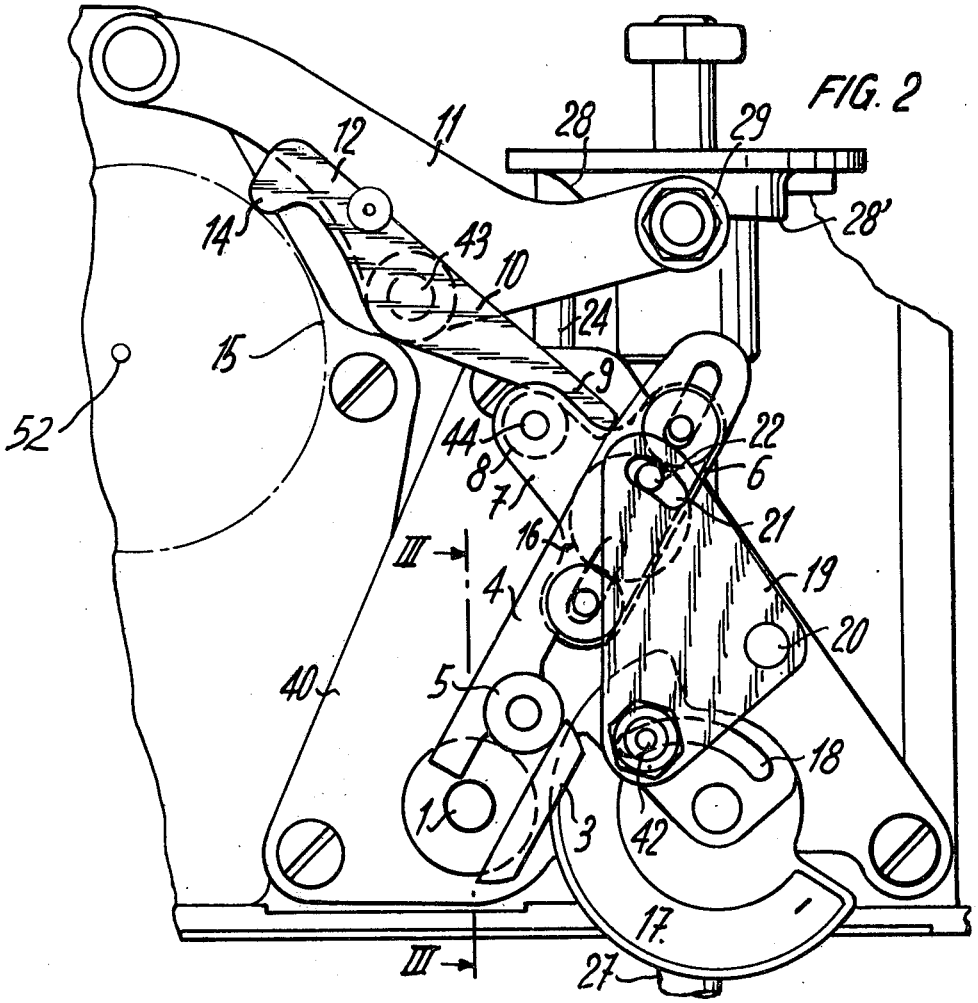
FIG. 2 is a partial longitudinal section along the line II—II of FIG. 1 on an enlarged scale.

As shown in FIG. 2, the shaft 1 has, at its upper end, a bearing member 3 disposed tangentially to its axis. A lever 4 carries near its free end a roller 5 in contact with the bearing member 3. The lever 4 is mounted in a manner to be displaceable longitudinally on a reversing lever 6, an arm 7 of which also carries a bearing roller 8, against which bears one end 9 of a lever 10, pivotally mounted on a movable support 11.

Figure 5:
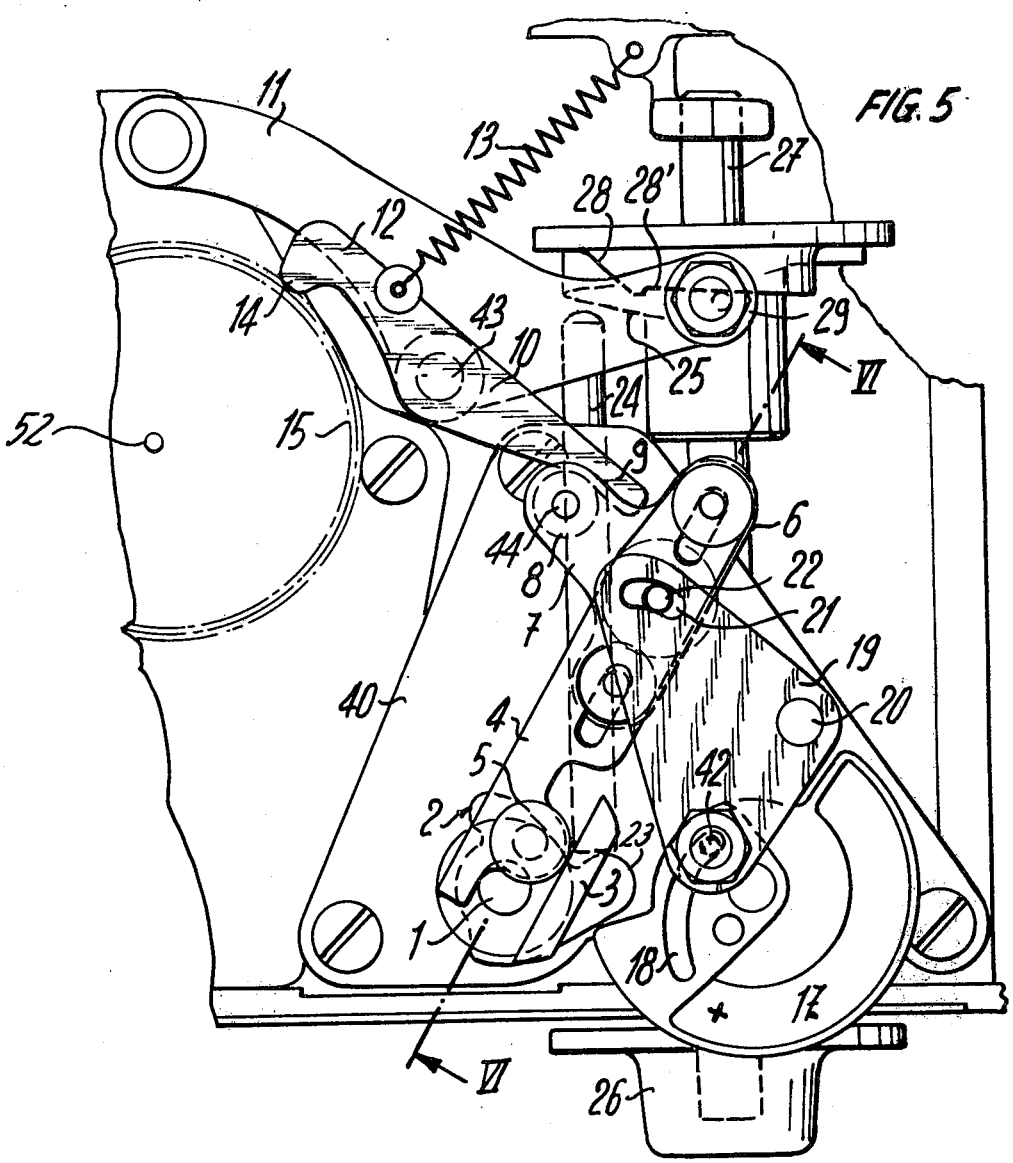
FIG. 5 is a partial longitudinal section similar to that of FIG. 2.
Figure 6:
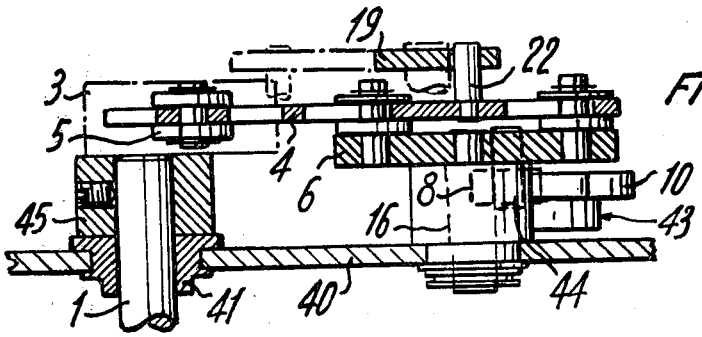
FIG. 6 is a partial section along the line VI—VI of FIG. 5.

As shown in FIGS. 2 and 5, in a position for automatically adjusting the direction and the amplitude of movement of the transporting claw, a follower 14 formed at the other end 12 of the lever 10 bears against a cam or eccentric 15 pivoted eccentrically on shaft 52 and transmits oscillations to the reversing lever 6 mounted on a pivot 16 (FIG. 6). This cam 15 is rotatably driven from the main driving shaft of the machine, not shown.

The oscillations of the reversing lever 6 are transmitted to the lever 4, the roller 5 of which bears against the bearing member 3 of the rotatable shaft 1. The amplitude of the oscillations thus transmitted to the shaft 1, and thus the amplitude of movement of the transporting claw of the machine, can be adjusted by changing the length of the arm of the lever 4 from the pivot 16, by displacing the lever 4 longitudinally on the reversing lever 6, for example from its position shown in FIG. 2 into its position shown in FIG. 5.

This longitudinal displacement of the lever 4 can be achieved by means of a knurled disc 17 having a guide groove 18, forming a cam for controlling a finger 42 mounted at one of the corners of a triangular lever 19 pivoted at 20 and having a slot 21 in which is engaged a peg 22 integral with the lever 4. This slot 21 which forms a cam for moving lever 4, maintains the roller 5 on a radius centered on the pivot 16 whatever the longitudinal position of the lever 4.

By turning knurled disc 17 anti-clockwise from the position shown in FIG. 2 into the position shown in FIG. 5, the arm of the lever 4 is increased from the pivot 16 and thus the amplitude of the movement of the material transporting claw guide of the machine is increased by the increased movement of bearing 3 on shaft 1 by roller 5.

In the non-transporting position of the lever 4, such as is shown in FIGS. 2 and 5, the longitudinal displacement of this lever 4 is effected parallel to a line connecting the pivot 16 to the axis of the oscillating shaft 1. Thus, the axis of the shaft 1 and the roller 5 are equidistant from the bearing member 3 whatever the length of the arm of the lever 4 from the pivot 16. Consequently, a displacement of the transporting claw guie is made towards the front and towards the rear by operation of cam 15 and levers 10,6,4, and engagement of roller 5 against bearing member 3, oscillating shaft 1.

The above described assembly mounted on a plate 40 screwed to the casing of the machine and having a hole for receiving the pivot 16 and a second hole for bush 41 receiving the shaft 1.

Figure 3:
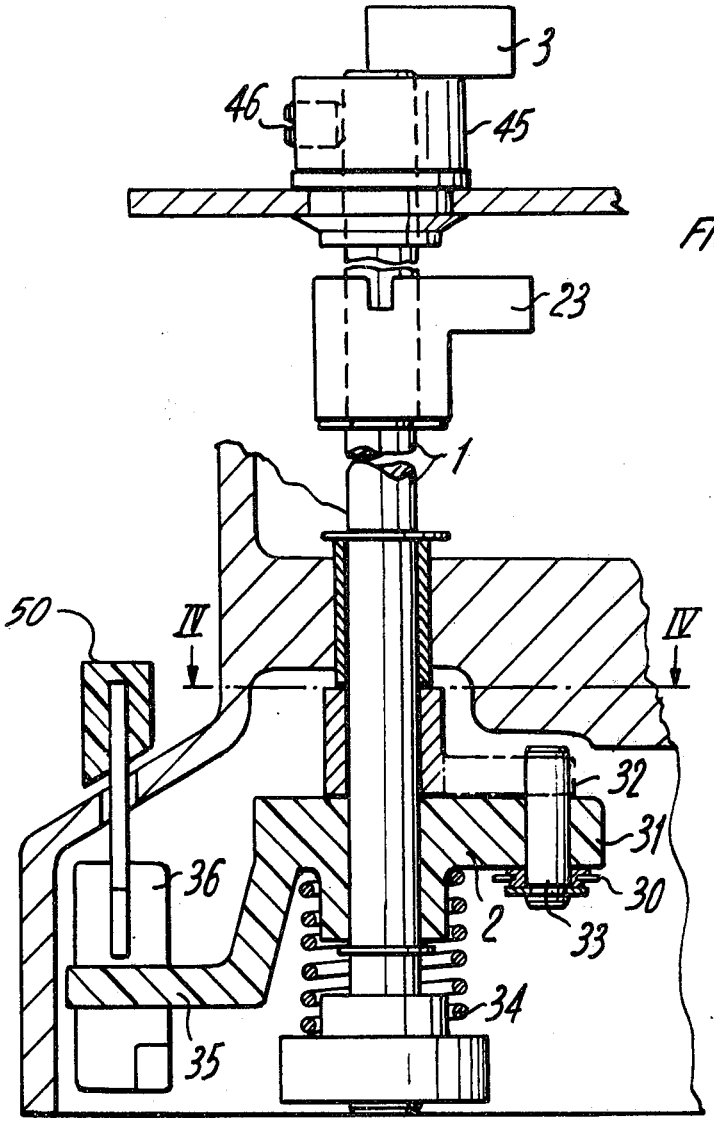
FIG. 3 is a partial section along the line III—III of FIG. 2.

As shown in FIGS. 3 and 5, the mechanism described is also adapted for manual operation of the shaft 1. To this end, the shaft 1 is provided with an arm 23, near its upper end, against which a pusher 24 engagable with a cam surface 25 can be displaced by turning a button 26 mounted at the end of a rotatable shaft 27. The cam surface 25 forms part of a double surfaced cam 25, 28, mounted on the shaft 27, and the pusher 24 is guided parallel to this shaft 27. To permit this manual adjustment, the cam surface 28 allows the follower 14 to be disengaged from the cam surface 15 by the return spring 13. To accomplish this, the movable support 11 of the lever 10 is pivoted at one end and provided at the other end with a follower 29 in contact with the cam surface 28.

When the button 26 is in the automatic adjusting position for the direction and the amplitude of movement of the transporting claw guide, the cam surface 28 maintains the support 11 in a position in which the follower 14 of the lever 10 is in contact with the cam surface 15.

On the other hand, when the button 26 is rotated to the manually adjustable position, the cam surface 28 will be in a position to allow follower 29 to rise so that pivot 43 and lever 10 will rise and follower 14 will disengage from contact with the cam surface 15. A spring 13 mounted between the casing of the machine and the end 12 of the lever 10 then holds the follower 14 away from the cam surface 15.

The pusher 24, will then be moved by the rotation of the cam surface 25 and will move parallel to the shaft 27, and will move the arm 23 integral with the shaft 1 to turn the shaft 1 through an arc.

It is to be noted that in the automatic adjusting position of the direction of the amplitude of the movement of the transporting claw guide (see FIG. 5), the cam surface 28 in contact with the follower 29 comprises a zone 28' inclined to the axis of the shaft 27 controlled by the button 26. It is thus possible, by turning the button 26, to compensate for the irregularities of the cam 15 due to the manufacturing tolerances during automatic operation.

Thus, by turning the button 26 in a counter-clockwise direction (FIG. 1) from its manual operating position for the oscillating shaft 1, the automatic adjustment of the direction and amplitude of the movement of the transporting claw guide by operation of cam 15 is effective as soon as the pusher 24 no longer operates on the arm 23 and support 11 and lever 10 are in the position shown in FIG. 2. By continuing to turn the button 26 in a counter-clockwise direction, one can then compensate the irregularities of the automatic adjusting cam 15.

Figure 4:
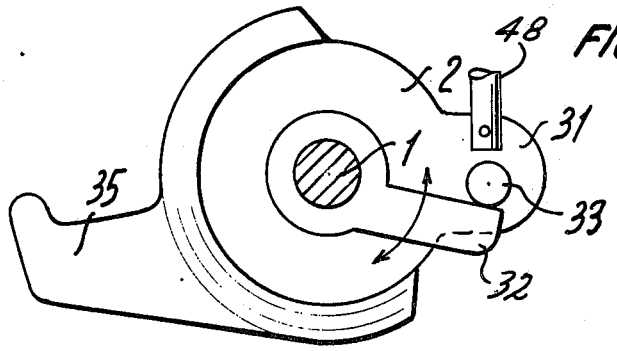
FIG. 4 is a partial section along the line IV—IV of FIG. 3.

As shown in FIGS. 3 and 4, the rotatable shaft 1 is connected to the mechanism of the transporting claw guide by a rod 48 pivoted to an arm 31 of the lever 2. This lever 2 is freely mounted on the shaft 1 at its end opposite to that which has the bearing member 3 and is normally rotated with this shaft 1 by an arm 32 integral with the shaft 1 which bears against a peg 33 engaged in a hole in the arm 31 of the lever 2. A return spring 34 maintains the peg 33 against the arm 32 of the shaft 1.

Another arm 35 of the lever 2 engages a pusher 36 having a handle 50 displaceable from left to right in the base of the machine of FIG. 1. This pusher 36 can thus turn the lever 2 on the shaft 1 against the action of the return spring 34 and effect an instant reversal of the direction of the movement of the transporting claw guide when it is desired to stop a forward stitch by a reverse stitch, regardless of the angular position of the shaft 1 and the method of control of this latter (manual or automatic).

For properly arranging the lever 10 and the reversing lever 6 to obtain proper alignment of the pivot 43 of the lever 10, and pivot 44 of the bearing roller 8 of the reversing lever 6, this roller 8 is relatively high and its periphery is in the form of a barrel.

In the automatic position, follower 14 is engaged with cam 15 and the movement of the cam is moving levers 10, 6 and 4 and shaft 1 in a back-and-forth motion so that the claw guide is being moved to effect a repeating back and forth stitching. In the manual position, with lever 10 raised so that follower 14 is not engaging cam 15, the claw guide is set in a desired position by the engagement of cam 25 with pusher 24, which engages arm 23 on shaft 1, and the stitching is done without the automatic back-and-forth movement.

When the machine is assembled, it is necessary to precede with the following adjustments:

After having set the button 26 to zero it is then turned in a clockwise direction causing cam 25 to depress pusher 24 and move arm 23 until it attains the non-transporting position of shaft 1. The angular position of the support 45 of the bearing member 3 is then adjusted on the shaft 1, in a manner to orientate this bearing member 3 parallel to a line passing through the shaft 1 and the pivot 16. The angular position of this support 45 is then fixed on the shaft 1 by means of a tightening screw 46.

The button 26 is then turned in an anti-clockwise position up to its automatic transporting position. The position of the follower 29 is then adjusted on the movable support 11 with respect to the cam surface 28, in a manner to ensure the engagement of the follower 14 of the lever 10 with cam 15, and the end 9 of the lever 10 with the bearing roller 8 of the reversing lever 6. This adjustment is made possible by the fact that the follower 29 is mounted on an eccentric pivot carried by the movable support 11 and can be secured against this latter by means of a nut once the adjustment has been made.

Similarly for the finger 42, engaged in the guide grooves 18 of the knurled disc 17, for which it is necessary to adjust the position of the end of the course of the groove 18 when the lever 4 is in its maximum extended position, shown in FIG. 5.

Of course, the cam can form part of a stack of cams simultaneously controlling the amplitude of the oscillations of the needle, as well as its de-centering in a zigzag sewing machine, such as is shown in FIG. 1, which comprises to this end a button 37 for a cam selection. Another button 38 is adapted for the manual adjustment of the width of the stitch.

We claim:

1. A mechanism for controlling the direction and the amplitude of the movement of a transporting claw guide for material to be sewn on a sewing maching, comprising a shaft connected at one end to the mechanism of the transporting claw guide, a cam, driven by a main driving shaft of the machine, and acting via a series of intermediate members, connected to the other end of the shaft, wherein, the series of intermediate members comprises a first lever, one end of which is provided with a follower in contact with a surface of the cam, a reversing lever in contact with the other end of the first lever, a second lever for rotating the oscillating shaft and mounted on the reversing lever in a longitudinally displaceable manner, a bearing member disposed on the end of the oscillating shaft opposite to the end connected to the mechanism of the transporting claw guide, and in contact with one end of the second lever, and a third lever connecting the second lever to a control member for the longitudinal displacement of the second lever, to adjust the position of its end in contact with the bearing member

2. A mechanism in accordance with claim 1, comprising a fourth lever freely mounted on the shaft on the end opposite to the bearing member and including a pair of arms, a rod pivotally mounted on and extending from one of said arms to the mechanism of the transporting claw guide, a first arm rigidly mounted on the shaft in a position to operate said fourth lever, and a return spring biasing said shaft to an adjusted position.

3. A mechanism in accordance with claim 2, in which the fourth lever, freely mounted on the shaft, comprises an arm permitting the manual rotation of the shaft against the action of the return spring.

4. A mechanism in accordance with claim 1 including a device for enabling manual adjustment of the shaft via a double surfaced cam, the first surface of which effecting the displacement of a pusher against a second arm mounted on the shaft, whilst the second cam surface allows disengagement of the follower of the first lever from the cam driven from the main driving shaft of the machine.

5. A mechanism in accordance with claim 4, in which the pusher is guided parallel to a shaft for the manual control of the double surface cam.

6. A mechanism in accordance with claim 1, in which the first lever is pivoted on a movable support the position of which, relative to the cam driven by the main driving shaft of the machine, is adjusted by a manually adjustable cam surface comprising a finely adjustable zone adapted to compensate the irregularities of the cam driven from the main driving shaft of the machine, due to manufacturing tolerances of this cam.

7. A mechanism in accordance with claim 1, in which in its non-transporting position, the second lever is guided parallel to a line connecting the pivot of the reversing lever to the axis of the shaft in a manner to permit it to transmit to the transporting claw guide oscillations of equivalent amplitude for forward or rearward transportation.

8. A mechanism in accordance with claim 1, in which the free end of the second lever is provided with a roller in contact with the bearing element of the shaft, the axes of the roller and of the shaft being equidistant from the bearing member in the non-transporting position regardless of the position of the second lever.

9. A mechanism in accordance with claim 1, in which the assembly of the mechanism operated by the first lever is mounted on a plate having two holes adapted respectively for receiving the pivot of the reversing lever and a bush traversed by the oscillating shaft.

10. A mechanism in accordance with claim 1, in which the third lever comprises a cam maintaining the second lever in alignment with the reversing lever at any selected longitudinally adjusted position.

11. A mechanism in accordance with claim 2, comprising a pusher consisting of a rod mounted parallel to the shaft, an arm rigidly mounted on said shaft in a position to be engaged by said pusher, whereby manual movement of said pusher will rotate said shaft and said fourth lever to operate the mechanism of the transporting claw guide.

* * * * *